US005651914A

United States Patent [19]

Schwörer

[11] Patent Number: 5,651,914

[45] Date of Patent: Jul. 29, 1997

[54] SUPPORT WITH REMOVABLE SUPPORT HEAD

[75] Inventor: Artur Schwörer, Senden, Germany

[73] Assignee: Peri b.v., Netherlands

[21] Appl. No.: 432,193

[22] PCT Filed: Oct. 31, 1993

[86] PCT No.: PCT/EP93/02820

§ 371 Date: Jul. 19, 1995

§ 102(e) Date: Jul. 19, 1995

[87] PCT Pub. No.: WO94/11595

PCT Pub. Date: May 26, 1994

[30] Foreign Application Priority Data

Nov. 6, 1992 [DE] Germany ..... 42 37 514.2

[51] Int. Cl.[6] ..... E04G 17/18

[52] U.S. Cl. ..... 249/210; 249/24; 249/211; 249/212

[58] Field of Search ..... 249/19, 24, 210, 249/211, 212

[56] References Cited

U.S. PATENT DOCUMENTS

| | | | |
|---|---|---|---|
| 827,268 | 7/1906 | Stieper | 249/211 |
| 1,707,420 | 4/1929 | Wales | 249/19 |
| 3,162,418 | 12/1964 | Dudley | 249/210 |
| 3,628,765 | 12/1971 | Sanders | 249/24 |
| 4,122,645 | 10/1978 | Tooley | 249/210 |
| 4,147,321 | 4/1979 | Gostling | 249/210 |
| 5,328,146 | 7/1994 | Lin | 249/210 |

FOREIGN PATENT DOCUMENTS

| | | | |
|---|---|---|---|
| 0473394 | 3/1992 | European Pat. Off. | E04G 11/48 |
| 466605 | 5/1914 | France . | |
| 2205913 | 5/1974 | France . | |
| 2254701 | 7/1975 | France | E04G 25/00 |
| 3515322 | 10/1986 | Germany | E04G 11/48 |

*Primary Examiner*—Thomas R. Weber
*Attorney, Agent, or Firm*—Walter A. Hackler

[57] ABSTRACT

The invention concerns a support with a removable support head for concrete moulding which exhibits, on its under side, an extension which engages a hollow section of the upper end of the support. The invention exhibits a spring-loaded ratchet (6, 16, 27) which is pivotably mounted on the extension (2), the ratchet engaging a stop (15) on the support to lock the mounted support head to the support.

13 Claims, 4 Drawing Sheets

SUPPORT WITH REMOVABLE SUPPORT HEAD

BACKGROUND OF THE INVENTION

The invention concerns a support with a removable support head which exhibits, on its under side, an extension engaging a hollow profile of the upper end of the support.

These types of support heads serve, with or without drop bushings, to support ceiling mould elements. In known supports, the extension of the support head exhibits an opening which, with seated support head, aligns with an opening in the support so that, by means of these two openings, a bolt can be introduced from the outside in a direction transverse to the longitudinal axis of the support, the bolt securely attaching the support head to the upper end of the support. It is also known to rigidly attach a head plate, running transversely to the support axis, to the upper end, the head plate having bore holes through which threaded bolts penetrate, the bolts being secured to a support head plate which likewise runs transversely the support axis. The support head is then secured with the assistance of nuts screwed onto the lower end of the threaded bolt. Mould systems for concrete include a plurality of support heads which are adapted to each application and, for example, support heads that are suitable for diagonal supports with which vertical moulding walls can be supported.

The underlying purpose of the invention is to develop a connection between a support and a support head which can be mounted quickly and which is easy to manufacture.

SUMMARY OF THE INVENTION

This purpose is achieved in accordance with the invention in that, on the extension of the support head, a spring-loaded ratchet is pivotably attached, the ratchet lockingly engaging a support stop of the support head mounted on the support.

The advantage of the invention is that, when mounting the support head on the upper support end, the spring-loaded ratchet latches behind the stop to thereby secure the support head on the support. Since, in embodiments of the invention, a support head base plate exhibits centering pins engaging centering holes in the head plate of the support when the support head is mounted, it is possible for the connection between the support head and the support according to the invention to already be sufficient to guide the forces which occur from the mould elements onto the supports. Where this appears questionable, auxiliary upper support end supports can be attached, in a matter which is known, in addition to the attachment of the support head in accordance with the invention. In any event, the attachment of the support head in accordance with the invention is useful for transporting the supports, with mounted support heads, without additional attachments.

The stop which, with mounted support head, is engaged by the ratchet, can be arbitrarily configured. It can, for example, be configured as a support pipe wall bolt which runs transverse to the support axis and penetrates through the hollow region of the hollow section. The portion of the ratchet which engages the stop is so configured that it, together with the stop, securely holds the support head in its mounted position on the support end.

The invention can be realized, with particular advantage, in a support which exhibits a head plate at its upper end, the plate exhibiting, in the vicinity of the inner region of the hollow profile, an opening through which the extension arranged on the under side of the support head penetrates. In an embodiment of the invention, the lower border of this opening serves as a stop for the ratchet which, when mounting the support head, initially, during penetration through the opening, is pushed back against the force of the spring and as soon as the region of the extension which contains the ratchet penetrates through the recess, the ratchet swings out again to engage the lower edge of the recess.

The release of the ratchet can, on the other hand, transpire in various ways. In one embodiment of the invention a base plate of the support head exhibits an opening through which the ratchet can be accessed and released with the assistance of a suitable rod-shaped tool or the like. This embodiment of the invention can be further improved when the ratchet exhibits an extension which travels upwards into the support head plate opening or is sufficiently long that it extends up into the support head base plate opening or even further upwards so that the ratchet can be swung back in a simple fashion.

In embodiments of the invention the ratchet exhibits, accessable from above through the openings, a depression which is suitably arranged for mounting of a rod-shaped tool to release the ratchet.

In embodiments of the invention an opening is provided in the wall of the support through which the ratchet is accessable for purposes of release so that for example a rod-shaped tool can directly engage that portion of the ratchet which engages the stop. A force can then be directly exercised on the ratchet which runs tangentially to the required pivotable motion for release.

In embodiments of the invention an opening can also be provided in the support wall through which a pin can be introduced to block a pivoting of the ratchet out of its locking position. Preferentially the rod-shaped tool, which is used to release the ratchet, can also be used for this purpose.

The invention can be used advantageously wherever the supports exhibit, at their upper ends, a relief arranged in the support axis, e.g. not only with the known supports which comprise a pipe, but also with supports exhibiting a different cross-sectional shape, by way of example which comprise a solid section and having, at their upper end, a central bore.

The spring force which guides the ratchet into the locking position, can be produced in various ways. A body made from an elastic plastic may be, for example, retroactively arranged in the pivoting region of the ratchet, after mounting of the support head and inserted into the openings of the base plate and/or the head plate. This has the advantage that the body covers the free space through this opening so that concrete or other impurities cannot penetrate through the openings.

In an improvement of this embodiment, the plastic body exhibits a cell structure such as, for example, sponge rubber.

The spring force can, however, also be produced by helical springs or, in one preferred embodiment, by a torsion spring.

The invention can be particularly advantageously used with supports having support head base plates which exhibit centering pins which, with mounted support head, engage support head plate centering holes.

Further features of the invention can be derived from the following description of the embodiments of the invention in connection with the claims and the drawing. The various features can be realized individually or collectively in embodiments of the invention.

In the drawing those parts of the embodiments which are necessary for the understanding of the invention are represented:

DESCRIPTION OF THE PREFERRED EMBODIMENT

Figure 1:
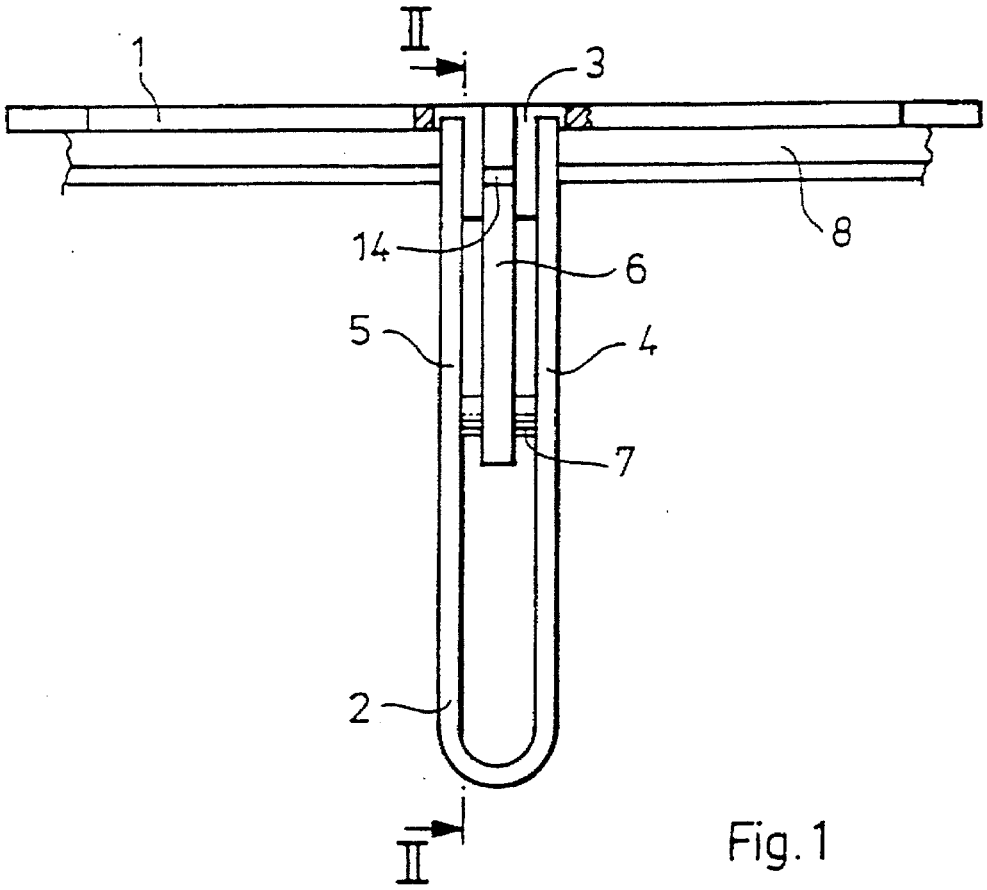
FIG. 1 shows a side view of the base plate of the support head with extension.

In the drawing those parts necessary for the understanding of the invention are represented. Only the support head base base plate 1 and its downwardly projecting extension 2 which is rigidly attached to the base plate 1 are represented. This extension comprises, in a known manner, a U-shaped flat bar the ends of whose upper legs, in the inventive embodiment represented, are welded to edges of a recess 3 in the base plate 1. A locking ratchet is located between the legs 4 and 5 of this U-shaped extension 2, which in the embodiment according to FIGS. 1 and 2 is designated with 6 and is pivotably mounted about a bolt 7 attached to the legs 4 and 5.

Figure 2:
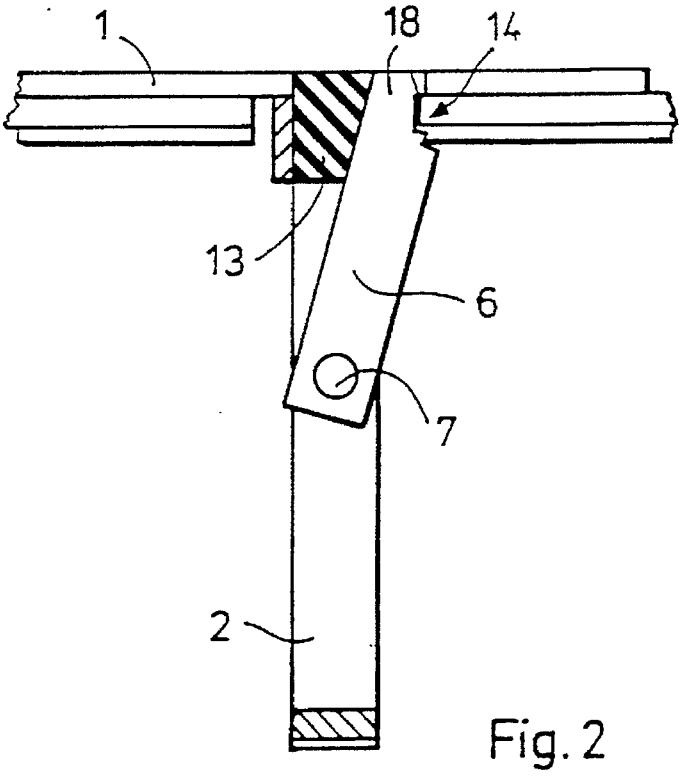
FIG. 2 shows a cut according to the line II—II of FIG. 1.
Figure 3:
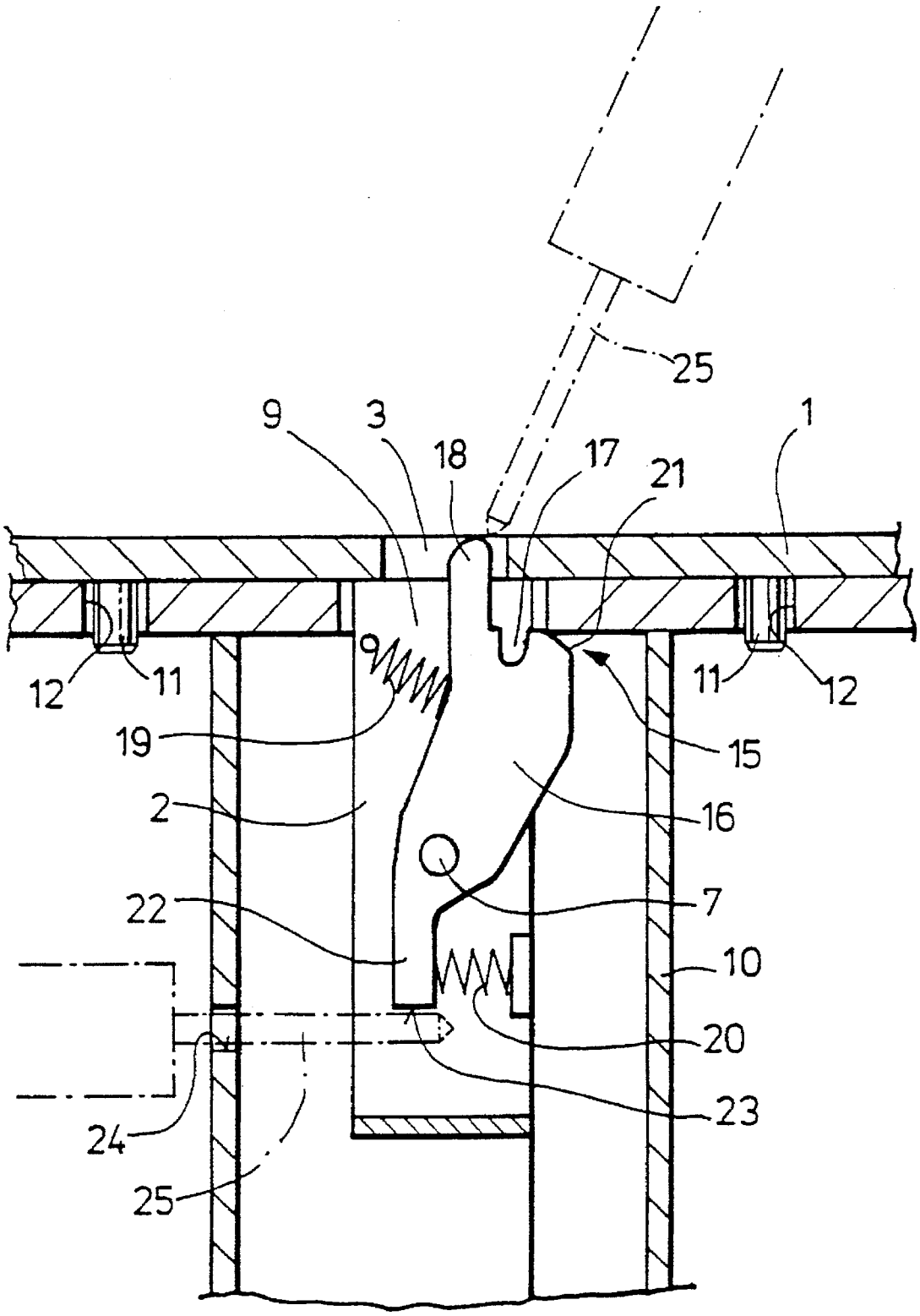
FIG. 3 shows a lengthwise cut through an upper support end with mounted support head in another embodiment of a locking ratchet.

In the embodiments shown in FIGS. 1 to 3 of the invention, a head plate 8 is welded to the upper support end, the head plate exhibiting a recess 9 which for a mounted support head, is provided in the vicinity of the recess 3", largely in the vicinity of the longitudinal axis of the support. In the embodiment according to FIG. 3 the support comprises a support pipe 10, whose hollow region is engaged by the extension 2.

Those components which are necessary to a support head are rigidly attached to the base plate 1. These components are not shown in the drawing. Furthermore, as is known per se, the base plate 1 exhibits centering pins 11 on its under side, which engage matching centering holes 12 in the head plate 8. The base plate can furthermore also exhibit threaded bolts on its under side which penetrate through the bores in the head plate 8. Threaded nuts can be screwed onto the lower ends of these threaded bolts, which are not shown, thereby, in addition to the connection produced by the locking ratchet 6, attaching the support head to the support.

In the embodiment of the invention shown in FIG. 2, a body 13 made from sponge rubber is inserted into the opening 3 of the base plate 1 to pivotably urge the ratchet 6 into the position represented in FIG. 2. This body 13 is sufficiently large to also penetrate through the opening 9 in the base plate 8. In the embodiment represented, the body 13 nearly completely closes the opening 3 and also a large portion of the opening 9. The body 13 can be secured in the opening 3, for example, glued or can also retroactively be inserted into this opening after the support head has been mounted on the support.

In the embodiment of a ratchet 6 shown in FIG. 2, the ratchet exhibits, in its upper region, a plurality of steps 14 with which it engages the lower edge 15 of the opening 9 after, when mounting the support head, it has penetrated sufficiently far through the recess 9 to be pivoted by the spring force. The ratchet 6 exhibits an extension 18 which reaches upward to the recess 3 and can be manipulated in the recess 3 with the assistance of a rod-shaped tool 25 and pivoted against the spring action so that the steps 14 can be pivoted away from under the edge of the opening 9 of the head plate 8 to thereby release the extension for the removal of the support head.

In the embodiment shown in FIG. 3, the ratchet 16 exhibits a depression 17 which likewise permits a rod-shaped tool to be introduced from above to pivot the ratchet 16 back against the spring force so that it becomes free from the lower edge of the head plate 8. In this embodiment of the invention it is not absolutely necessary for the ratchet 16 to exhibit an extension 18 which projects upwardly into the recess 3.

In the embodiment according to FIG. 3 the spring force is produced by means of two helical springs 19 and 20 which attempt to so pivot the ratchet about the bolt 7 that the upper edge 21 or 14 of the ratchet engages the lower edge 15 of the head plate 8.

In the embodiment of the invention represented in FIG. 3 the ratchet exhibits, projecting downwardly out beyond the pivot bolt, another extension 22 which is engaged by the spring 20. Furthermore, the extension 22 exhibits another surface 23 which runs transversely to the longitudinal axis of the support. An opening 24 is located in the support wall 10, through which a rod-shaped tool 25 can be introduced transversely to the longitudinal direction of the support and inserted under the surface 23 so that the ratchet 16 is supported and locked in the engagement position. The rod-shaped tool 25 can also be utilized to engage the upwardly directed extension 18 and to pivot and unlock the ratchet 16 against the direction of the spring force.

Figure 4:
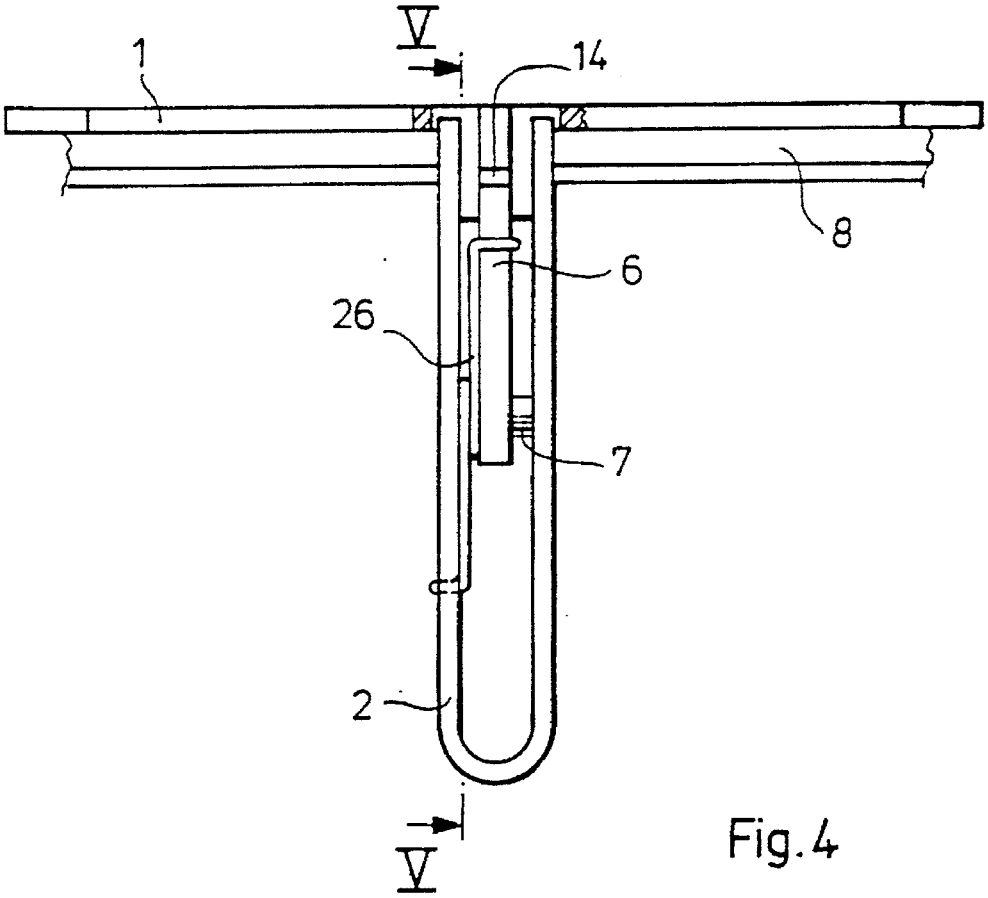
FIG. 4 shows a cut through the lower part of a support head.
Figure 5:
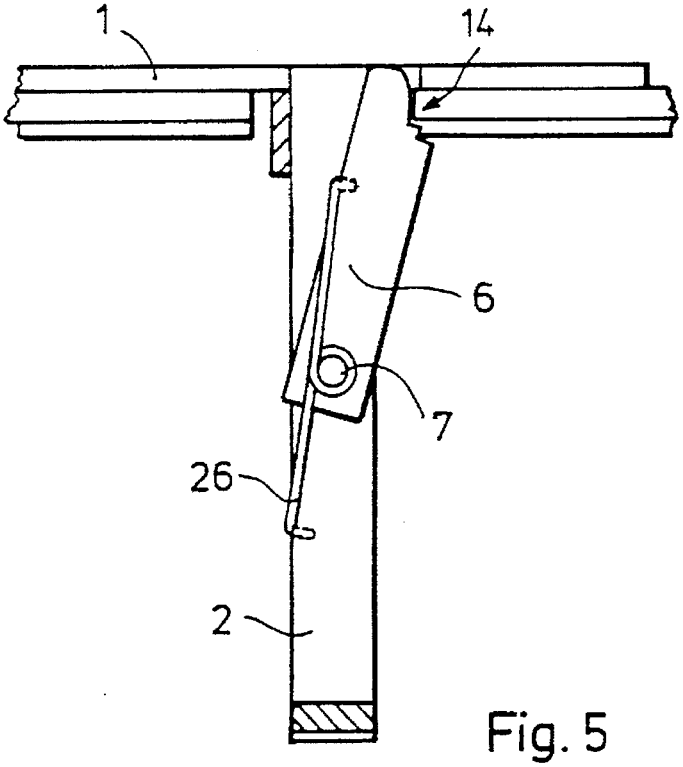
FIG. 5 shows a cut according to the line V—V of FIG. 4.

The embodiment according to FIGS. 4 and 5 distinguishes itself from the embodiments according to FIGS. 1 through 3 in that the spring force which directs the ratchet 6 into its locking position is produced by means of a leg spring 26.

Figure 6:
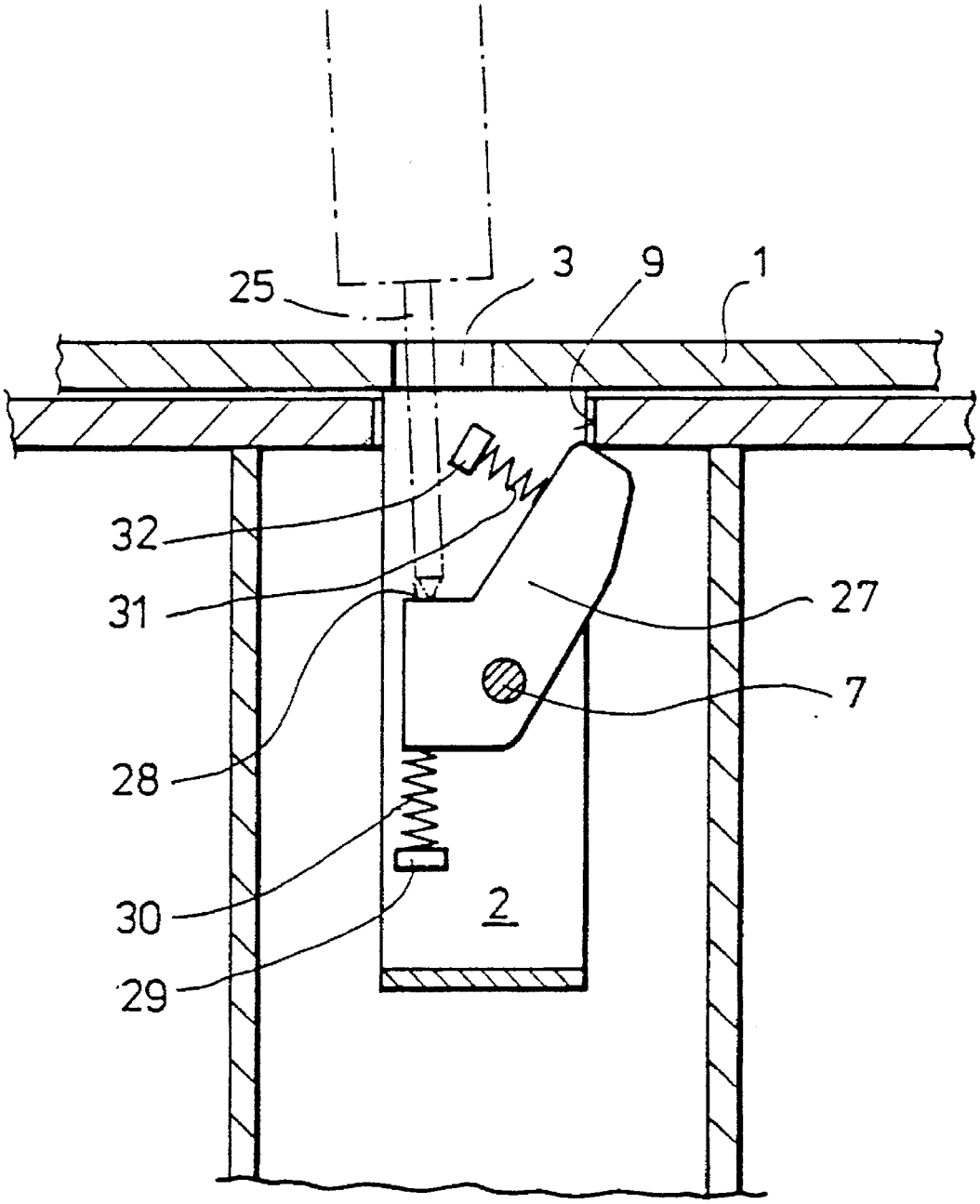
FIG. 6 shows a further embodiment of the invention in a representation corresponding to FIG. 3.

The embodiment according to FIG. 6 distinguishes itself from the previously described embodiments in that the ratchet 27 does not exhibit an upwardly directed extension 18, rather the rod-shaped tool 25 penetrates through the openings 3 and 9 and must be pressed against a surface 28 so that a force is excercised upon the ratchet 27 which is directed downwardly at a distance from the pivot bolt 7. This embodiment exhibits a spring 30 supported by a support 29 of the legs 4 and 5 which engages the lower side of the ratchet 27 as well as, in addition, a helical spring 31 which is supported by a support 32 of the legs 4 and 5.

The support head can by mounted on every conventional ceiling support which exhibits a projection protruding towards the inside. The connection in accordance with the invention cannot only be used for mounting support heads onto supports, but also for the mounting of other appropriate elements, for example, junction members for scaffoldings or frames.

We claim:

1. A support system for concrete molds comprising:

a support having a hollow section and an opening disposed at an upper end of said support; and a removable support head having an extension disposed at an under side of said support head, said extension having a spring-loaded ratchet pivotably mounted thereto, said extension penetrating through said opening into said hollow section to lock said support head to said support.

2. The support system of claim 1, wherein said support comprises a head plate having said opening through which said extension penetrates when said support head is mounted, said opening having a lower edge which forms a stop for said ratchet.

3. The support system of claim 2, wherein said support head comprises a base plate having a hole through which said ratchet is accessible for purposes of release.

4. The support system of claim 3, wherein said ratchet comprises an extension which extends upwardly into said hole of said base plate.

5. The support system of claim 3, wherein said ratchet exhibits a depression which is accessible through said base plate hole and said head plate opening, said depression being adapted to accept a tool for releasing said ratchet.

6. The support system of claim 1, wherein said support comprises a wall having an opening through which said ratchet is accessible for purposes of release.

7. The support system of claim 1, wherein said support comprises a wall having an opening and further comprising a pin which is adapted to be introduced through said support wall opening to block the pivotal motion of the ratchet.

8. The support system of claim 1, further comprising an elastic plastic body to spring-load said ratchet for urging said ratchet into a locking position.

9. The support system of claim 8, wherein said plastic body exhibits a cell structure.

10. The support system of claim 1, further comprising a torsion spring to spring-load said ratchet.

11. The support system of claim 1, wherein said support head comprises a base plate having centering pins and an upper end of said support comprises a head plate having centering holes, whereby said centering pins engage said centering holes for mounting said support head.

12. The support system of claim 1, wherein said ratchet comprises an extension reaching downwardly beyond a pivot bolt which, when said support head is mounted, cooperates with a tool introduced transversely into said support.

13. A support system for concrete molds comprising:

a support having a hollow section and a head plate disposed at an upper end of said support, said head plate having an opening; and a removable support head having an extension disposed at an under side of said support head, said extension having a spring-loaded ratchet pivotably mounted thereto, said extension penetrating through said opening into said hollow section, said ratchet engaging a lower edge of said opening to lock said support head to said support.

* * * * *